US007686642B2

(12) United States Patent
Pearson et al.

(10) Patent No.: US 7,686,642 B2
(45) Date of Patent: Mar. 30, 2010

(54) WIRE HARNESS INTERCONNECTION AND RETENTION METHOD AND APPARATUS

(75) Inventors: Dennis Pearson, Foothill Ranch, CA (US); Terry Horwitz, Garden Grove, CA (US)

(73) Assignee: Tempo Industries, Inc., Irvine, CA (US)

( * ) Notice: Subject to any disclaimer, the term of this patent is extended or adjusted under 35 U.S.C. 154(b) by 0 days.

(21) Appl. No.: 12/167,191

(22) Filed: Jul. 2, 2008

(65) Prior Publication Data

US 2009/0221175 A1 Sep. 3, 2009

Related U.S. Application Data

(60) Provisional application No. 61/033,346, filed on Mar. 3, 2008.

(51) Int. Cl.
*H01R 4/24* (2006.01)

(52) U.S. Cl. ..... 439/423

(58) Field of Classification Search ..... 439/423, 439/422, 421, 424, 502, 503, 623, 624
See application file for complete search history.

(56) References Cited

U.S. PATENT DOCUMENTS 3,875,947 A * 4/1975 Jula et al. ..... 607/131
4,062,613 A 12/1977 Tritenne
4,082,402 A * 4/1978 Kinkaid et al. ..... 439/422
4,429,352 A * 1/1984 Griffin ..... 362/109
4,480,460 A 11/1984 Bush et al.
4,578,545 A 3/1986 Phillipson
4,776,809 A 10/1988 Hall
4,829,146 A 5/1989 Duve
5,158,477 A 10/1992 Testa et al.
5,611,709 A * 3/1997 McAnulty ..... 439/422
5,989,058 A 11/1999 Norgaard
6,394,836 B2 * 5/2002 Nagai ..... 439/422
6,402,543 B1 * 6/2002 Abe et al. ..... 439/407
6,565,377 B2 * 5/2003 Sawayanagi et al. ..... 439/422
6,652,310 B2 * 11/2003 Onuma ..... 439/422
6,657,127 B2 * 12/2003 Saito ..... 174/84 C

* cited by examiner

*Primary Examiner*—T C Patel
*Assistant Examiner*—Harshad C Patel
(74) *Attorney, Agent, or Firm*—Greenberg Traurig LLP; Franklin D. Ubell

(57) ABSTRACT

A smaller conductor having an uninsulated portion and an insulated portion is positioned adjacent a larger conductor having an insulated portion and a conductive portion located within the insulated portion of the larger conductor. The two conductors are joined by a discontinuous metal band having respective ends extending across a top portion of the insulated portion of the larger conductor to make electrical contact with the uninsulated portion of the smaller conductor, then bending downward on one side of the conductor pair and then upward and through the insulated portion of the larger conductor such that a first of the ends of the metal band is positioned in contact with the conductive portion of the larger conductor; the metal band bending downward on the opposite side of the conductor pair and then upward and through the insulated portion of the larger conductor such that a second of the ends of the metal band is positioned in contact with the conductive portion of the larger conductor.

4 Claims, 6 Drawing Sheets

WIRE HARNESS INTERCONNECTION AND RETENTION METHOD AND APPARATUS

RELATED APPLICATIONS

This application claims the benefit of and priority to U.S. Provisional Application Ser. No. 61/033,346, filed Mar. 3, 2008, entitled "Wire Harness Interconnection and Retention Method and Apparatus," the contents of which are incorporated by reference herein in its entirety.

FIELD

The subject invention relates generally to wire interconnection apparatus and methods and more particularly to a method of more simply and economically establishing an electrical connection between adjacent conductors, as well as a "clam shell" harness retainer for adjacent interconnected pairs of wires.

RELATED ART

Procedures are known in the art for interconnecting adjacent bare portions of metal conductors. Such procedures have been recognized by the inventors to involve time-consuming stripping of insulation and interconnections which exhibit less than ideal electrical characteristics.

SUMMARY

A smaller conductor having an uninsulated portion and an insulated portion is placed adjacent a larger conductor such that an insulated portion of the larger conductor is positioned adjacent the uninsulated portion of the smaller conductor. A discontinuous metal band having respective ends is then attached around the two conductors such that it makes electrical contact with the uninsulated portion of the smaller conductor and such that the respective ends of the metal band pierce the insulated portion of the larger conductor and make electrical contact with the conductive portion of the larger conductor which lies within the insulation.

DRAWINGS

DETAILED DESCRIPTION

Figure 1:
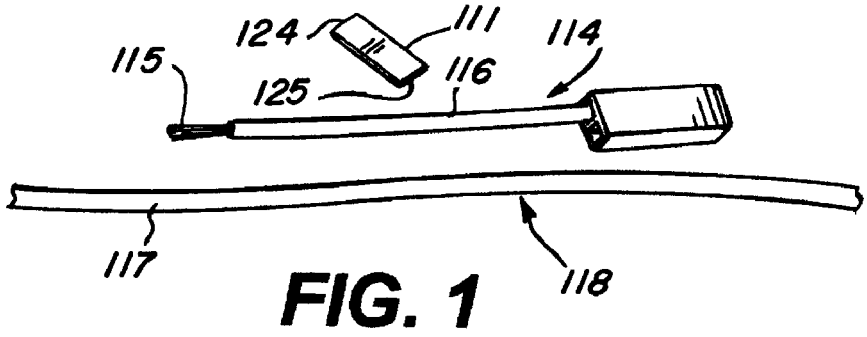
FIG. 1 is a perspective view of first and second conductors adjacent one another.

According to an illustrative embodiment, a larger electrical conductor 118, for example, a 16 gauge wire, is joined to a smaller electrical conductor 14, for example, a 26 or 18 gauge wire, using a metal connecting band 111, which may be, for example, a thin brass strip.

The smaller electrical conductor 114 has a short portion of its outer plastic insulation 116 removed at one end thereof for a length of, for example, approximately ⅛ inch. The exposed metal conductor wire 115 is then placed adjacent to the larger electrical conductor 118 such that the exposed metal wire 115 of the smaller conductor 114 makes physical contact with the plastic insulation 117 of the larger conductor 118.

The metal band 111 is then placed on top of these two conductors 114, 118 and then is wrapped down and around both sides of the conductors 114, 118, holding them firmly in place and establishing metal to metal contact between the band 111 and the exposed metal wire 115 portion of the small conductor 114.

Figure 2:
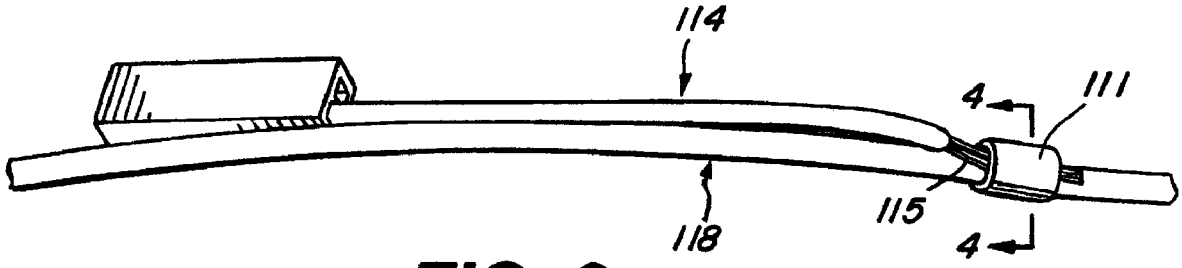
FIG. 2 is a top perspective view of the conductors of FIG. 1 after being joined together by a metal band.
Figure 3:
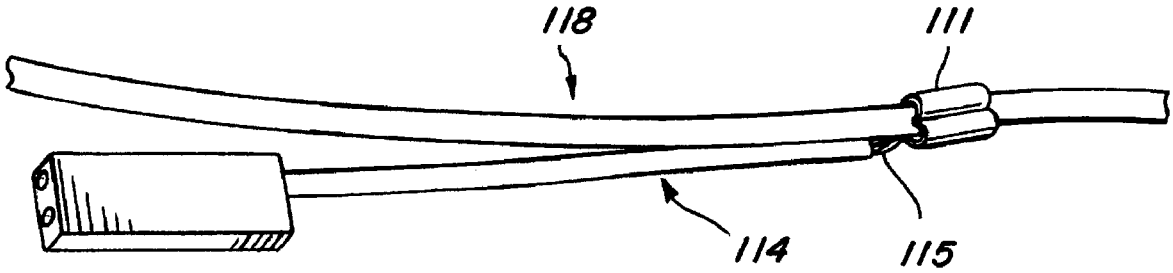
FIG. 3 is a bottom perspective view of the conductors of FIG. 2 after being joined together by a metal band.

The metal band 111 is then made to continue down and around the bottom of the larger conductor 118 such that both ends 124, 125 of the band 111 curl up and into the bottom of the larger conductor 118. The ends 124, 125 of the metal band 111 then pierce and penetrate the plastic insulation 117 of the larger conductor 118 and proceed up and into the metal electrical conducting wire 119 (FIG. 4) inside to form a finished connection as shown in FIGS. 2 and 3. The metal band 111 now provides direct electrical contact between the metal wire 119 inside the larger conductor 118 and the exposed metal conductor wire 115 of the smaller electrical conductor 114, thereby providing direct flow of electrical current from the larger electrical conductor 118 to the smaller conductor 114.

Figure 4:
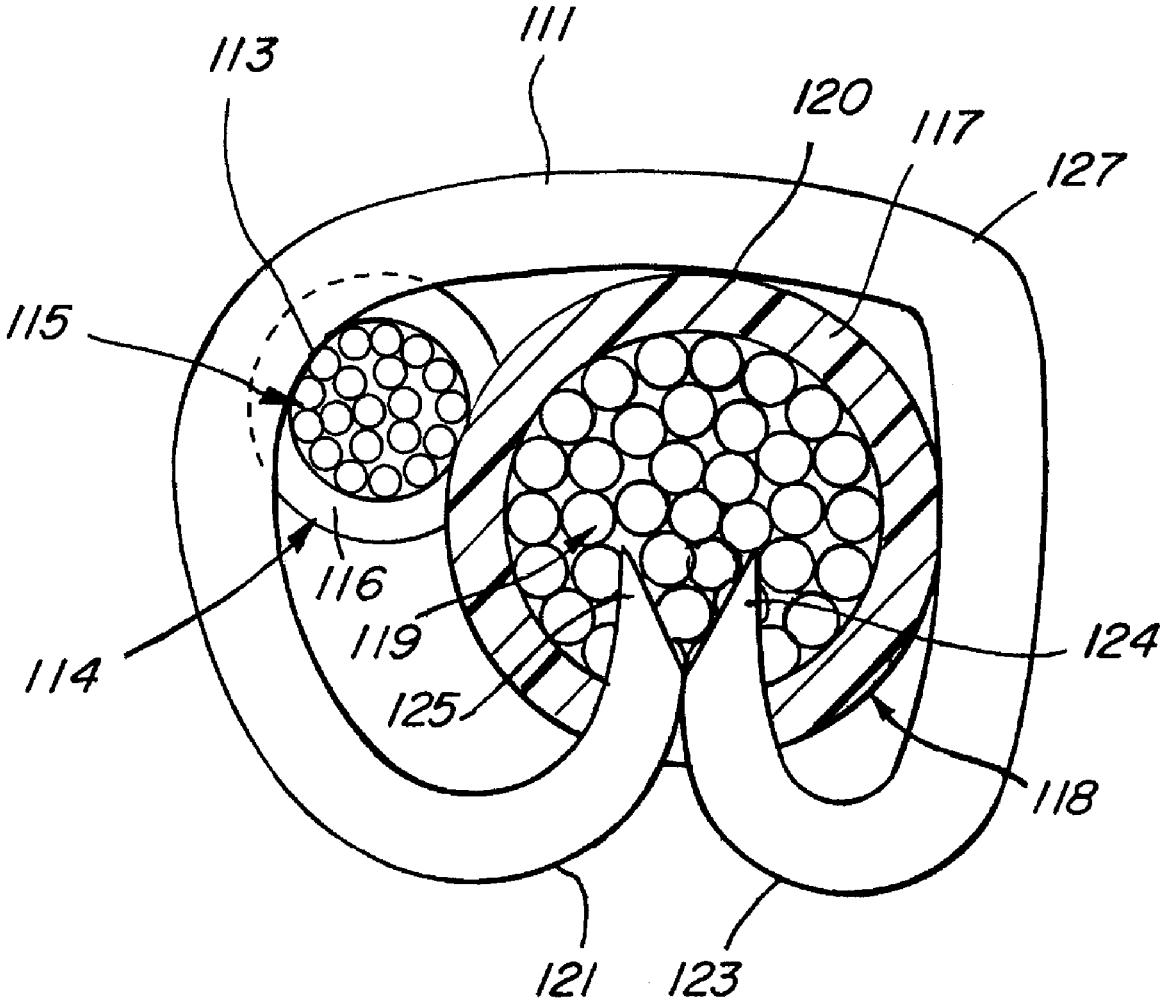
FIG. 4 is a cross-sectional view taken at 4-4 of FIG. 2.

The connection resulting from the just described process is shown in more detail in FIG. 4. At the upper left of FIG. 4, the metal band 111 contacts the bare metal portion 115 of the smaller conductor 114 generally at 113, then bends downwardly, and then bends upwardly at 121 to pierce the insulation 117 of the larger conductor 118 and enter into conductive engagement with the current carrying conductor portion 119 of the larger conductor 118. The current-carrying conductor portion of both the larger and smaller conductors 114, 118 is typically made up of a group of smaller fine-wire conductors or filaments, for example, 34 in number for a 16 gauge wire.

The opposite side of the metal band 111 engages the insulation 117 of the larger conductor 118 generally at 120, then bends downwardly at 127, and then upwardly at 123 to pierce the insulation 117 and enter into conductive engagement with the current-carrying conductor portion 119 of the larger conductor 118. As may be seen, the respective ends, 124, 125 of the metal band are preferably pointed or otherwise shaped to assist in penetrating the insulation 118.

The formation of a wire interconnection as illustrated in FIG. 4 may be automated using an automatic wire splicing machine such as model 121K2049 as manufactured by the Autosplice Company, San Diego, Calif. Such a machine has provisions for feeding a continuous brass strip into a mandrel where interconnections are formed.

Figure 6:
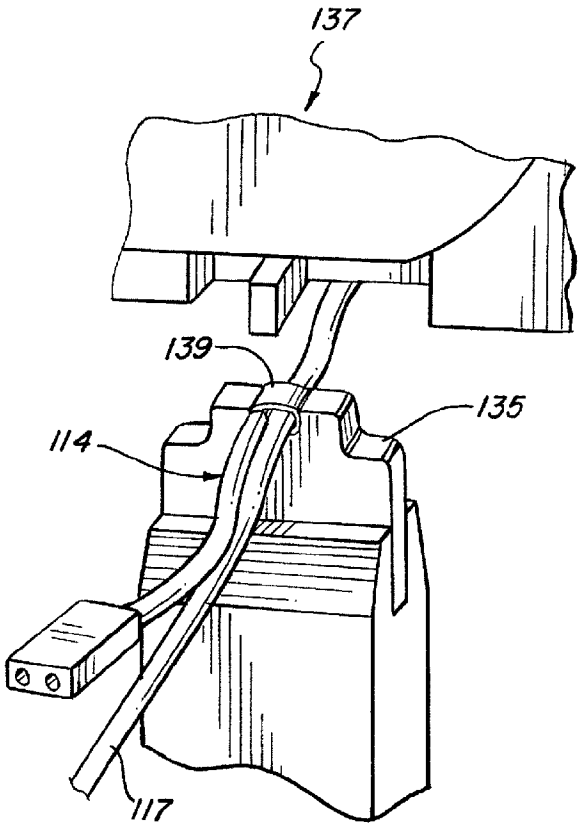
FIG. 6 is a partial perspective view of the conductors of FIG. 5 after being joined by a metal band applied by the splicing machine.
Figure 5:
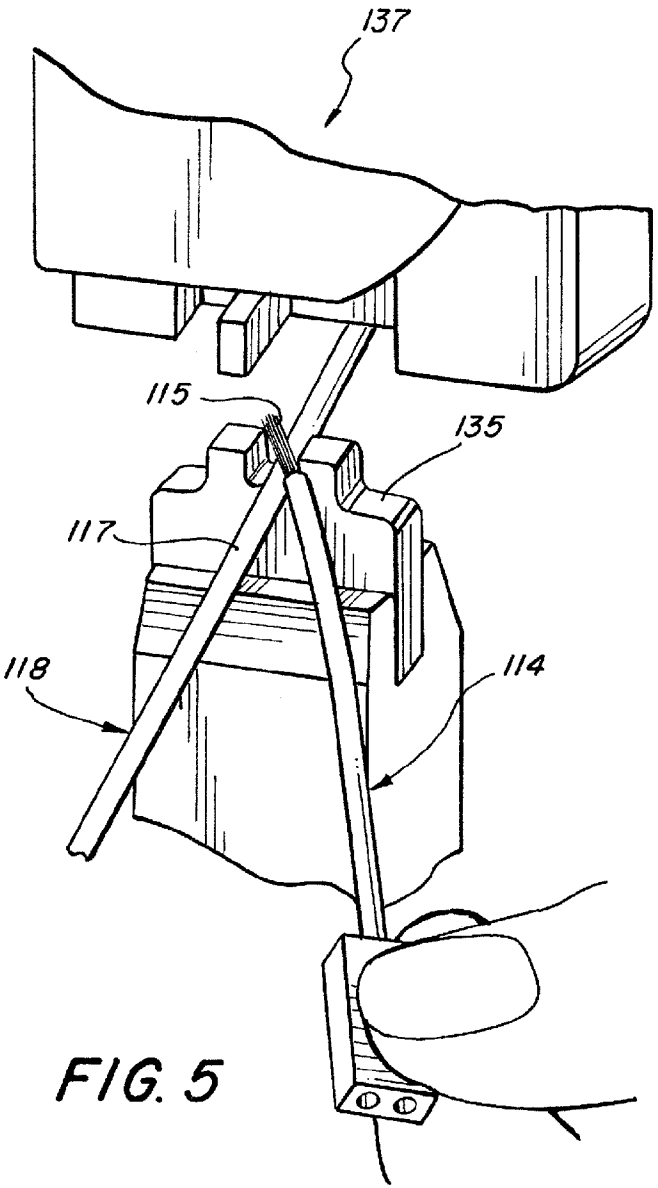
FIG. 5 is a partial perspective view of an uninsulated end of a first conductor placed adjacent the insulated portion of a second conductor in a mandrel associated with an automatic splicing machine.
Figure 7:
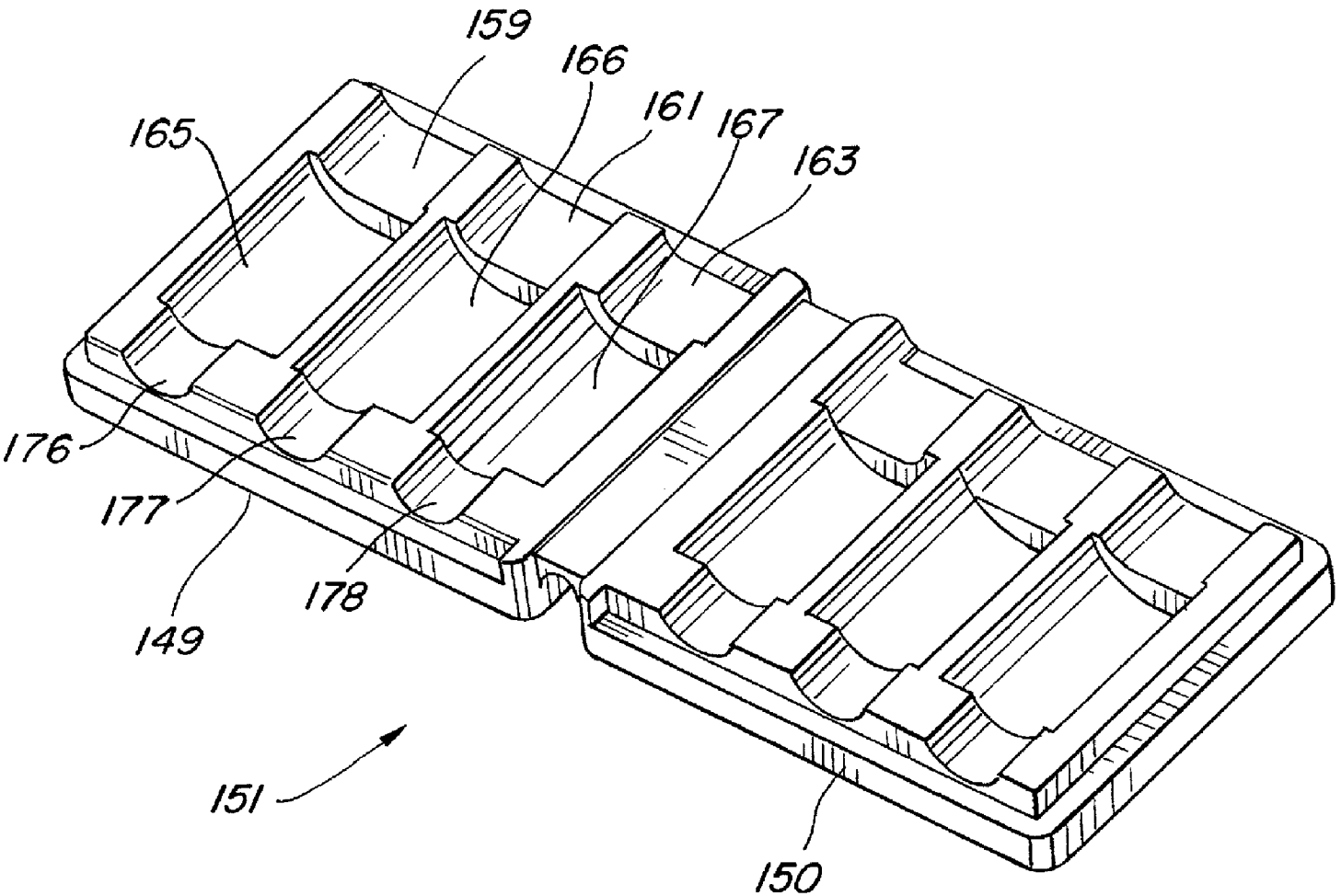
FIG. 7 is a perspective view of a wire harness retainer according to an illustrative embodiment.

In order to form an interconnection as shown in FIG. 4, a mandrel of appropriate cross-section is fabricated, and the brass strip feeding mechanism is modified to pull more brass than a conventional operation. FIG. 5 illustrates the exposed metal wire 115 of a smaller conductor being placed in the jaws of a mandrel 135 on top of the insulation 117 of a larger conductor 118 in such an autosplice machine 137. The machine 137 is then activated and a finished connection 139 of the form shown in FIG. 4 is automatically formed in the mandrel 135, as illustrated in FIG. 6.

In order to facilitate formation of a wire harness including several adjacent wire interconnections of the type shown in FIG. 4, a special wire harness retainer or "clamshell" receptacle 151 having two pivotally interconnected halves 149, 150 is provided, as shown in FIGS. 7-14.

Figures 8, 9, 10, 11:
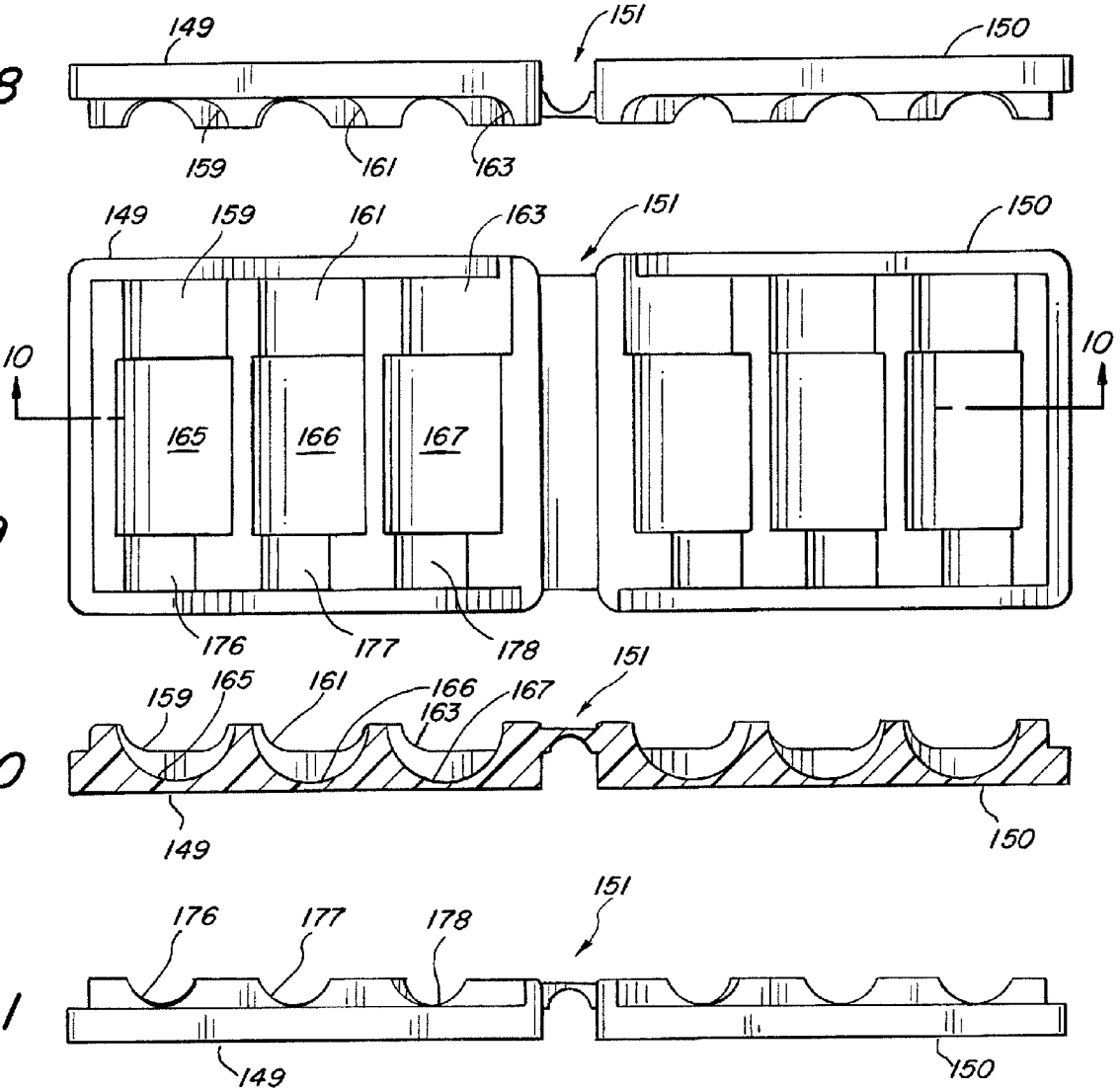
FIG. 8 is an end view of the retainer of FIG. 7.
FIG. 9 is a top view of the retainer of FIG. 7.
FIG. 10 is a sectional view taken at 10-10 of FIG. 9.
Figures 12, 13, 14:
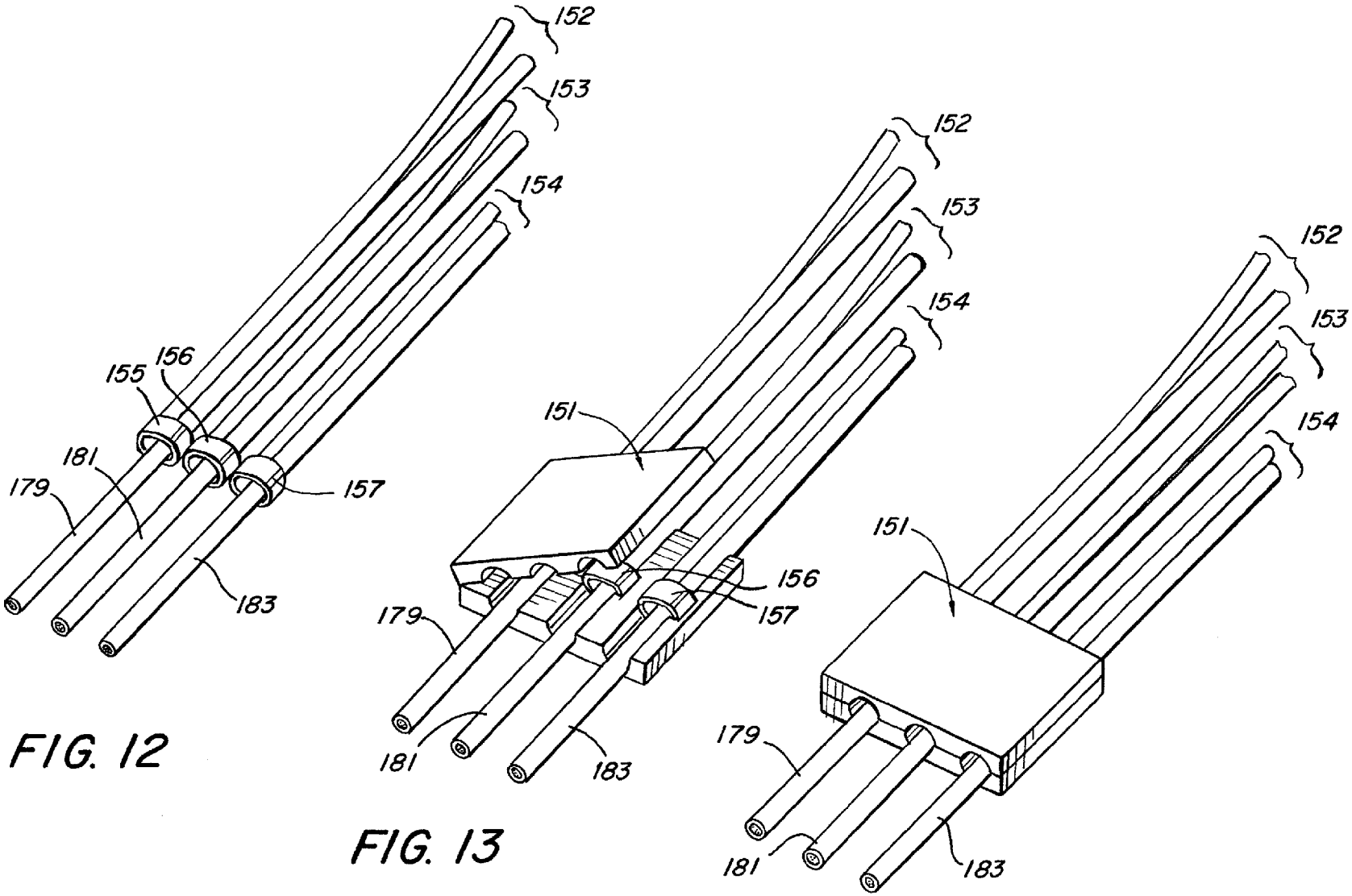
FIGS. 12-14 are perspective views illustrating steps associated with use of the illustrative embodiment of FIGS. 7-10.

As illustrated in FIGS. 12-14, the receptacle 151 accepts 3 adjacent wire pairs 152, 153, 154 employing metal band interconnections 155, 156, 157. Three rearward wire guide receptacles 159, 161, 163 are formed in the retainer 151 and shaped to receive the wire pairs 152, 153, 154. The rearward receptacles 159, 161, 163 lead into respective central receptacles 165, 166, 167, which are shaped to receive the metal band interconnections 155, 156, 157. As shown in FIG. 10, these central receptacles 165, 166, 167 may have an arcuate cross-section. The central receptacles 165, 166, 167 lead into respective forward wireguide receptacles 176, 177, 178, which are shaped to receive the single lead wires 179, 181, 183, which emanate from the metal band interconnections 155, 156, 157. The mating half 150 of the retainer 151 may be a mirror image of the mating half 149, and has respective matching rearward, forward and central receptacles for receiving the wire pairs 152, 153, 154; metal band interconnects 155, 156, 157 and single lead wires 179, 181, 183.

In operation, the individual wire assemblies are laid out side-by-side in the bottom half 149 of the clamshell 151. Each wire (with its metal crimp) rests in an individual track shaped such that there is no movement or contact with adjacent wire assemblies. The mating top half 150 drops over the bottom half 149 and entraps the wire assemblies inside. The top and bottom halves 149, 150 snap fittingly "lock" or are otherwise arranged, e.g. by gluing, to stay fixed in place with respect to one another.

The overall assembly preferably has a very low profile height after it is assembled and an overall width which is preferably no more than is necessary to hold the wires in place. While pivotally interconnected halves 149, 150 are illustrated in the drawings, they could be separate disconnected pieces; which snap together or employ other interlocking mechanisms.

In various embodiments, the retainer 151 provides the advantage of holding the interconnections together, providing strain relief for the interconnections, and preventing one metal band from contacting an adjacent band, thereby preventing short circuits. Protection from corrosion and external elements is also provided.

We claim:

1. An apparatus comprising:

a smaller conductor having an uninsulated portion and an insulated portion;

a larger conductor having an insulated portion positioned adjacent the uninsulated portion of said smaller conductor and a conductive portion lying within said insulated portion of said larger conductor; and a discontinuous metal band having respective ends extending across a top portion of the insulated portion of said larger conductor to make electrical contact with said uninsulated portion of the smaller conductor, the metal band then bending downward on a first side and then upward and through said insulated portion of said larger conductor such that a first of said ends is positioned within said insulated portion of said larger conductor and in contact with said conductive portion; the metal band bending downward on a second side and then upward and through said insulated portion of said larger conductor such that a second of said ends is positioned within said insulated portion of said larger conductor and in contact with said conductive portion.

2. The apparatus of claim 1 wherein said smaller conductor is a 26 gauge conductor and said larger conductor is a 16 gauge conductor.

3. The apparatus of claim 1 wherein each of said first and second ends is shaped to pierce and does pierce said insulating portion of said larger conductor.

4. The apparatus of claim 1 wherein said smaller conductor is an 18 gauge conductor.

* * * * *